US008876630B2

(12) United States Patent
Takechi

(10) Patent No.: US 8,876,630 B2
(45) **Date of Patent: *Nov. 4, 2014**

(54) GOLF CLUB HEAD

(75) Inventor: Takaharu Takechi, Minato-Ku (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 39 days.

This patent is subject to a terminal disclaimer.

(21) Appl. No.: 13/548,973

(22) Filed: Jul. 13, 2012

(65) Prior Publication Data

US 2013/0017903 A1 Jan. 17, 2013

(30) Foreign Application Priority Data

Jul. 15, 2011 (JP) ..... 2011-156672
Jul. 15, 2011 (JP) ..... 2011-156673

(51) Int. Cl.
*A63B 53/04* (2006.01)
*A63B 59/00* (2006.01)

(52) U.S. Cl.
CPC ..... *A63B 53/047* (2013.01); *A63B 53/0466* (2013.01); *A63B 2053/0491* (2013.01); *A63B 59/0092* (2013.01)
USPC ..... 473/332; 473/335; 473/338; 473/342; 473/350

(58) Field of Classification Search
USPC ..... 473/324–350, 287–292
See application file for complete search history.

(56) References Cited

U.S. PATENT DOCUMENTS

| | | | | |
|---|---|---|---|---|
| 2,163,091 | A * | 6/1939 | Held | 473/338 |
| 5,316,298 | A | 5/1994 | Hutin et al. | |
| 6,659,883 | B2 * | 12/2003 | Nelson et al. | 473/324 |
| 7,004,852 | B2 * | 2/2006 | Billings | 473/332 |
| 7,384,348 | B2 * | 6/2008 | Lin et al. | 473/332 |
| 7,621,822 | B2 * | 11/2009 | Roach | 473/329 |
| 7,637,823 | B2 * | 12/2009 | Shimazaki et al. | 473/332 |
| 7,749,100 | B2 * | 7/2010 | Tavares et al. | 473/332 |
| 7,775,904 | B2 * | 8/2010 | Hirano | 473/332 |
| 8,267,807 | B2 * | 9/2012 | Takechi et al. | 473/332 |
| 8,449,408 | B2 * | 5/2013 | Clausen et al. | 473/335 |
| 2007/0129160 | A1 * | 6/2007 | Matsunaga et al. | 473/332 |

FOREIGN PATENT DOCUMENTS

| | | |
|---|---|---|
| JP | 6-510689 A | 12/1994 |
| JP | 2011-030837 A | 2/2011 |

* cited by examiner

*Primary Examiner* — Sebastiano Passaniti
(74) *Attorney, Agent, or Firm* — Sughrue Mion, PLLC

(57) ABSTRACT

A golf club head of an iron type includes a face plate part for hitting a ball, which has a cavity part on the back side thereof; a sole part; a hosel part for connecting the head to a shaft; a viscoelastic body made to adhere to the back face of the face plate part, the viscoelastic body including a board-shaped part located on the back face of a central portion of the face plate part and extending parts extending from the board-shaped part to the toe side and the heel side of the head; and a cover plate lapping over the viscoelastic body, the cover plate including a concavity for accommodating the board-shaped part of the viscoelastic body and concave lines for accommodating the extending parts of the viscoelastic body. The cover plate has an opening, and a part of the viscoelastic body is exposed through the opening.

6 Claims, 8 Drawing Sheets

GOLF CLUB HEAD

CROSS-REFERENCE TO RELATED APPLICATION

The present application claims the right of priority of Japanese Patent Applications Nos. 2011-156672 and 2011-156673 filed on Jul. 15, 2011, which form a part of this specification, by citing these applications herein.

BACKGROUND OF THE INVENTION

The present invention relates to a golf club head. More particularly, the present invention relates to an iron-type golf club head in which a viscoelastic body is adherently disposed on the back face of a face plate part. Still more particularly, the present invention relates to a golf club head in which a viscoelastic body is made to adhere to a part of the outer face thereof, and a cover plate is provided so as to cover the viscoelastic body.

The iron-type golf club head includes at least a face plate part for hitting a ball, a sole part, and a hosel part. The golf club is formed by inserting and fixing a shaft in the hosel part.

To absorb a shock or vibrations occurring on the golf club head when a ball is hit by using the golf club, in some cases, a viscoelastic material such as rubber is made to adhere onto the golf club head, or is incorporated in a void of the golf club head.

JP 06-510689 T describes a golf club head in which an elliptical viscoelastic body that is made of butyl rubber or the like and has a major axis of 45 mm, a minor axis of 18 mm, and a thickness of 1 mm is bonded onto the back face of the face plate part, and also a 1-mm thick nameplate made of an aluminum-zinc-magnesium alloy is bonded onto the viscoelastic body.

This patent Document describes that the viscoelastic plate and the hard plate have the same size. Therefore, the whole of the end face of the viscoelastic plate is exposed to the atmospheric air, so that the viscoelastic plate is liable to be deteriorated by moisture or ultraviolet rays, or to peel off the back face of the face plate part. Also, since the viscoelastic plate absorbs vibrations propagating from the face plate part side only, the vibration absorbing action of the viscoelastic plate is sometimes insufficient.

To solve the above-described problems, JP 2011-30837 A discloses a golf club head of an iron type in which the durability of adhesion of the viscoelastic plate to the face plate part is excellent and which has a face plate part for hitting a ball, a sole part, and a hosel part for connecting a shaft thereto as a golf club head that has superior vibration absorbing effects. In this golf club head, a viscoelastic body is made to adhere to the back face of the face plate part, and a nameplate lapping over the viscoelastic body is provided, and it is characterized in that the nameplate has an expanding part expanding to the surroundings of the viscoelastic body, and the expanding part is made to adhere to the back face of the face plate part.

For the golf club head disclosed in this patent Document, the viscoelastic body is made to adhere to the back face of the face plate part, and further, the nameplate is provided so as to cover the viscoelastic body. The nameplate has the expanding part expanding to the surroundings of the viscoelastic body, and the expanding part is made to adhere to the back face of the face plate part. Therefore, the viscoelastic body is covered with the nameplate in an enclosed form, and is not exposed to the atmospheric air. For this reason, the viscoelastic body is not splashed with water, nor is it irradiated directly by ultraviolet rays, so that the durability of the viscoelastic body and the durability of adhesion of the viscoelastic body to the back face of the face plate part are excellent.

Also, in this patent Document, since the expanding part of the nameplate is made to adhere to the face plate part, some of the vibrations occurring in the peripheral edge portion of the face plate part at the ball hitting time (shot time) propagates to the viscoelastic body via the nameplate and is absorbed by the viscoelastic plate.

SUMMARY OF THE INVENTION

In JP 2011-30837 A described above, since the viscoelastic body is provided only in a central portion of the back face of the face plate part, there is some room for improvement in the vibration absorbing effects.

An object of the present invention is to provide a golf club head that has excellent vibration absorbing effects.

Another object of the present invention is to provide a golf club head that has excellent durability of adhesion of a viscoelastic plate to a face plate part and excellent vibration absorbing effects.

The present invention provides, as one mode thereof, a golf club head, which is of an iron type, including a face plate part for hitting a ball, which has a cavity part on the back side thereof; a sole part; a hosel part for connecting the head to a shaft; a viscoelastic body made to adhere to the back face of the face plate part, the viscoelastic body including a board-shaped part located on the back face of a central portion of the face plate part and extending parts extending from the board-shaped part to the toe side and the heel side of the head; and a cover plate (or a nameplate) lapping over the viscoelastic body, the cover plate including a concavity for accommodating the board-shaped part of the viscoelastic body and concave lines for accommodating the extending parts of the viscoelastic body.

The tip end faces of the extending parts of the viscoelastic body may be covered with a wall part formed in the peripheral edge portion of the cover plate.

The viscoelastic body and the cover plate may be affixed to the back face of the face plate part with an adhesive or a gluing agent.

The cover plate may be formed of a metal having a thickness of 0.2 to 0.4 mm.

The sole part may include mountain parts, which are convex from the face of the sole part on the cavity part side toward the substantially vertical direction on the toe side and the heel side thereof, and valley parts, which are located between the mountain parts; and the surface connecting the top portions of the mountain parts with the back face of the face plate part may be inclined toward the sole part with respect to the outer side surface of the sole part. In this case, the distance between the lowermost edge of the back face of the face plate part and the outer side surface of the sole part may increase gradually from the center part toward the toe side and the heel side.

According to this mode of the present invention, the viscoelastic body is made to adhere to the back face of the face plate part, and further the cover plate is provided so as to cover the viscoelastic body. The cover plate has the concavity in the central portion and concave lines extending from the concavity, the viscoelastic body is disposed in the concavity and concave lines, and the end face of the viscoelastic body is not at all exposed or is scarcely exposed to the atmospheric air. Therefore, the viscoelastic body is not splashed with water, nor is it irradiated directly by ultraviolet rays, so that the durability of the viscoelastic body and the durability of adhesion of the viscoelastic body to the back face of the face plate part are excellent.

According to this mode of the present invention, some of the vibrations occurring in the peripheral edge portion of the face plate part at the ball hitting time (shot time) propagates to the viscoelastic body via the cover plate and is absorbed by the viscoelastic plate. Therefore, the vibration absorbing effect is excellent.

According to this mode of the present invention, the viscoelastic body is provided with the extending parts on the toe side and the heel side. Therefore, the vibrations at the time when a ball is hit by the toe side or the heel side of the face plate part are immediately absorbed by the extending part located just close to the hit portion, so that the vibration absorbing effect is high. The vibrations at the time when a ball is hit by a portion that does not lap over the board-shaped part and the extending parts of the face surface (for example, an upper portion or a lower portion on the toe side or an upper portion or a lower portion on the heel side of the face surface) propagate to the viscoelastic body via not only the face plate part but also the flat portion (the portion excluding the concavity and the concave lines) of the cover plate and are absorbed by the viscoelastic body.

According to this mode of the present invention, the distance between the lowermost edge of the back face of the face plate part and the outer side surface of the sole part is increased gradually from the center part toward the toe side and the heel side, and therefore the cover plate exists down to the vicinity of the sole part, so that the area of the cover plate is large. For this reason, the vibrations at the time when a ball is hit by a lower portion on the toe side or the heel side of the face surface propagate easily to the viscoelastic body via the cover plate, so that the vibration absorbing effect is achieved.

The present invention provides, as another mode, a golf club head including a viscoelastic body made to adhere to at least one portion of the outer side surface of the golf club head; and a cover plate lapping over the viscoelastic body, the cover plate having an opening, and a part of the viscoelastic body being exposed through the opening.

The golf club head may be of an iron type; the golf club head may include a face plate part for hitting a ball; and the viscoelastic body and the cover plate may be disposed on the back face of the face plate part.

Also, the golf club head may be of a wood type; the golf club head may include a sole part; and the viscoelastic body and the cover plate may be disposed in a depressed part provided in the sole part.

The cover plate may be formed of a metal having a thickness of 0.2 to 0.4 mm.

Of the viscoelastic body, a portion exposed through the opening may protrude through the opening. In this case, of the viscoelastic body, the portion exposed through the opening may have a thickness changing partially.

According to this mode of the present invention, the viscoelastic body is made to adhere to a part of the outer surface of the golf club head, and further the cover plate is provided so as to cover the viscoelastic body. The opening is formed in a part of the cover plate, and a part of the viscoelastic body is exposed through the opening. Some of vibrations occurring when a ball is hit by this golf club head is absorbed by the viscoelastic body. A part of the viscoelastic body is exposed through the opening in the cover plate, and the exposed part of the viscoelastic body vibrates without being restrained by the cover plate and absorbs the vibrations, so that the vibration absorbing effect is excellent.

The portion of the viscoelastic body exposed through the opening has a thickness changing partially. Thereby, vibrations in a wide frequency zone are absorbed efficiently.

DESCRIPTION OF THE PREFERRED EMBODIMENTS

Figure 1:
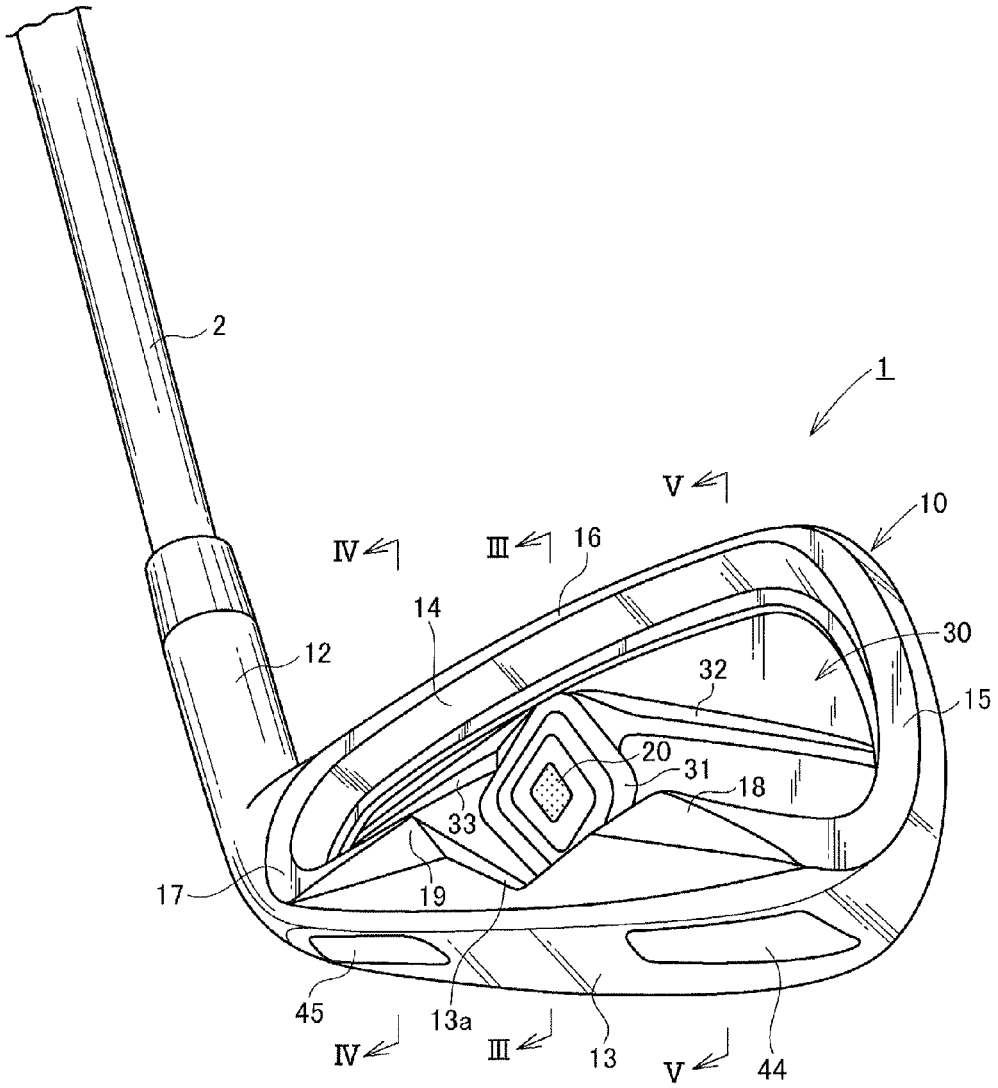
FIG. 1 is a perspective view of one embodiment of a golf club head in accordance with the present invention, as viewed from the sole side of the rear face side thereof.

A first embodiment of a golf club head in accordance with the present invention will now be described with reference to FIGS. 1 to 9.

An iron-type golf club head 1 of the first embodiment is attached to the tip end of a shaft 2, and includes a golf club head body 10, a viscoelastic body 20 made to adhere to the back face of a face plate part 11 of the golf club head body 10, and a cover plate 30 that covers the viscoelastic body 20 and is made to adhere to the back face of the face plate part 11.

The golf club head body 10 has the face plate part 11, a hosel part 12, and a sole part 13. The rear surface side of the face plate part 11 forms a cavity part 14. The cavity part 14 extends from the toe side to the heel side (player side), and the periphery thereof is surrounded by a toe-side convex part 15, a top-side convex part 16, and a heel-side convex part 17. These convex parts 15 to 17 rise from the peripheral edge of the face plate part 11 to the rear. The back face of the face plate part 11 is formed into a flat surface excluding the vicinities of the convex parts 15 to 17 and the sole part 13.

The upper face portion of the sole part 13 consists of a toe-side mountain part 18, a heel-side mountain part 19, and a valley part 13*a* between the mountain parts 18 and 19.

The height of the top portions of the mountain parts 18 and 19 from the sole face is 5 to 20 mm, especially 6 to 10 mm, larger than the height of the valley part 13*a* from the sole face.

Figure 9:
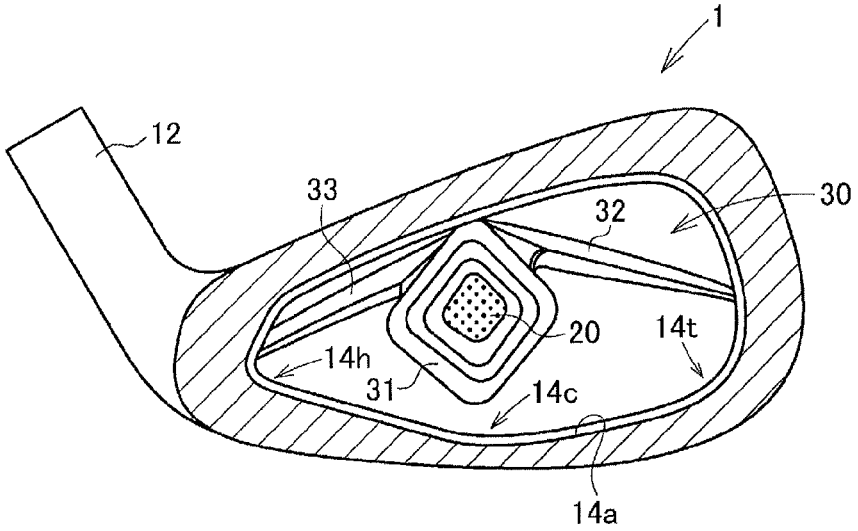
FIG. 9 is a sectional view taken along the line IX-IX of FIG. 3.
Figure 10:
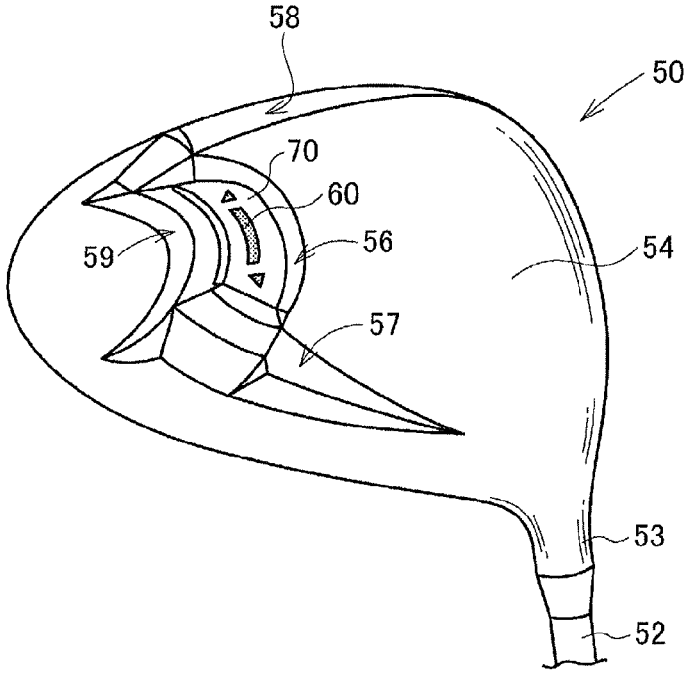
FIG. 10 is a perspective view of a wood-type golf club head in accordance with another embodiment, as viewed from the sole side thereof.
Figure 11:
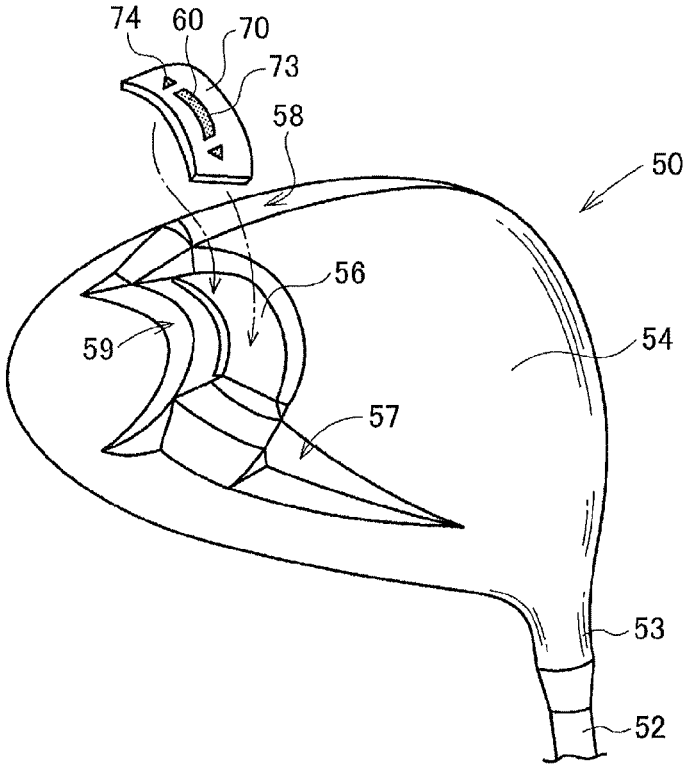
FIG. 11 is an exploded view of the golf club head shown in FIG. 10.
Figure 12:
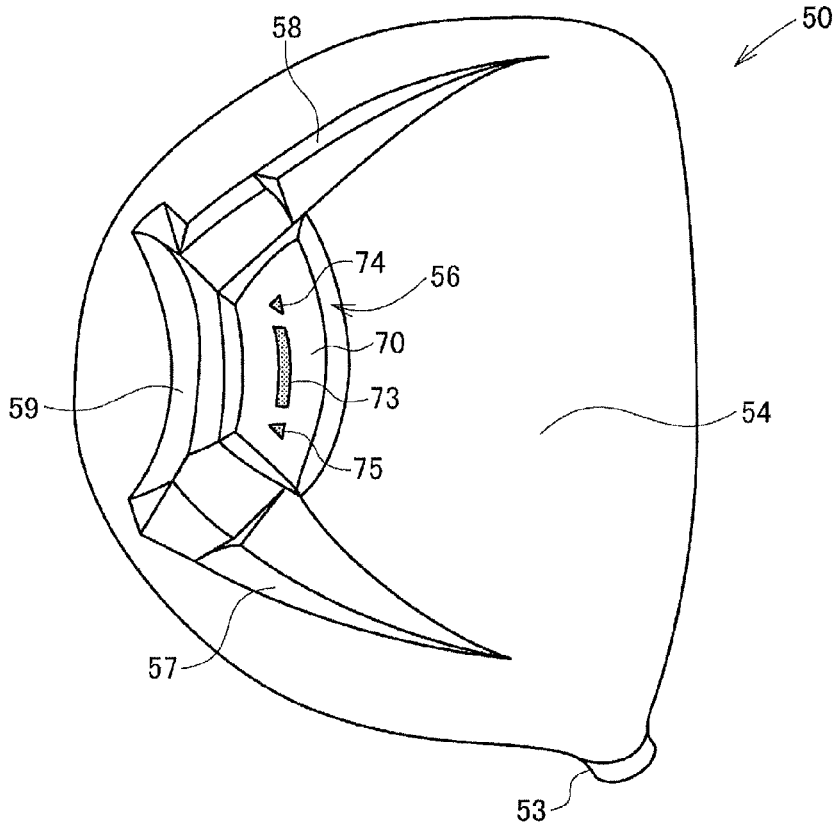
FIG. 12 is a bottom view of the golf club head shown in FIG. 10.
Figure 13:
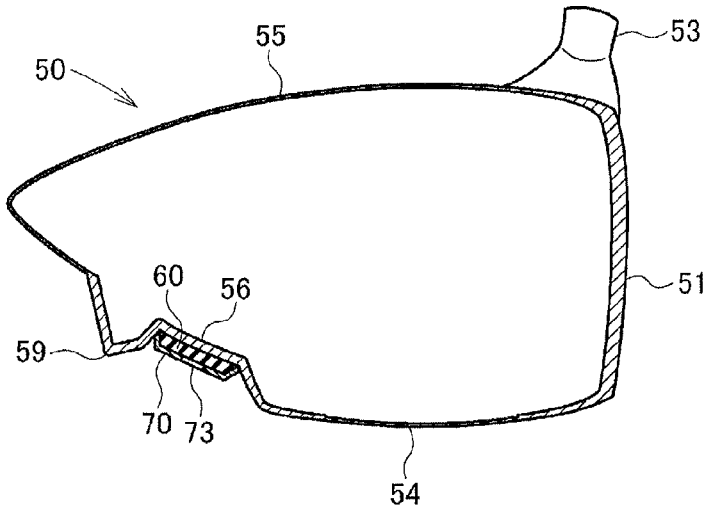
FIG. 13 is a longitudinal sectional view of the golf club head shown in FIG. 10.

The surfaces on the face plate part 11 side of the mountain parts 18 and 19 form inclined planes 18*a* and 19*a* having a downgrade toward the face plate part 11. As shown in FIG. 9, the lowermost edge of the back face of the face plate part 11, that is, a bottom part 14*a* of the cavity part 14 has a gentle downgrade from a toe side 14*t* and a heel side 14*h* to a center part (an intermediate portion in the toe-to-heel direction) 14*c*.

That is, the distance between the bottom part 14*a* and the sole face is the shortest in the center part 14*c*, and increases gradually from the center part 14*c* to the heel side 14*h* and the toe side 14*t*.

In this embodiment, the bottom face (sole face) on the toe side and the heel side of the sole part 13 is formed with concave holes 40 and 41 (FIG. 2), respectively, and the inner portions of the concave holes 40 and 41 are filled with vibration absorbing materials 42 and 43 consisting of rubber or elastomer, respectively. The inlet portions of the concave holes 40 and 41 form enlarged portions each having an opening area larger than the area of the inner portions of the concave holes 40 and 41, and in the enlarged portions of the concave holes 40 and 41, weight materials 44 and 45 each consisting of a high-density metallic material having a specific gravity of 10 or more, preferably 12 or more, such as tungsten or tungsten alloy, are fitted, respectively. The weight materials 44 and 45 are fixed to the golf club head body 10 by laser welding, caulking, or the like means.

As a material for the vibration absorbing materials 42 and 43, rubber in which butyl bromide rubber or chlorobutyl rubber is blended in natural rubber or the like, NBR (acrylonitrile-butadiene rubber), silicone rubber, styrene type elastomer, olefin type elastomer, urethane type elastomer, ester type elastomer, amide type elastomer, and the like are cited. Among these materials, NBR is best suitable.

Figure 2:
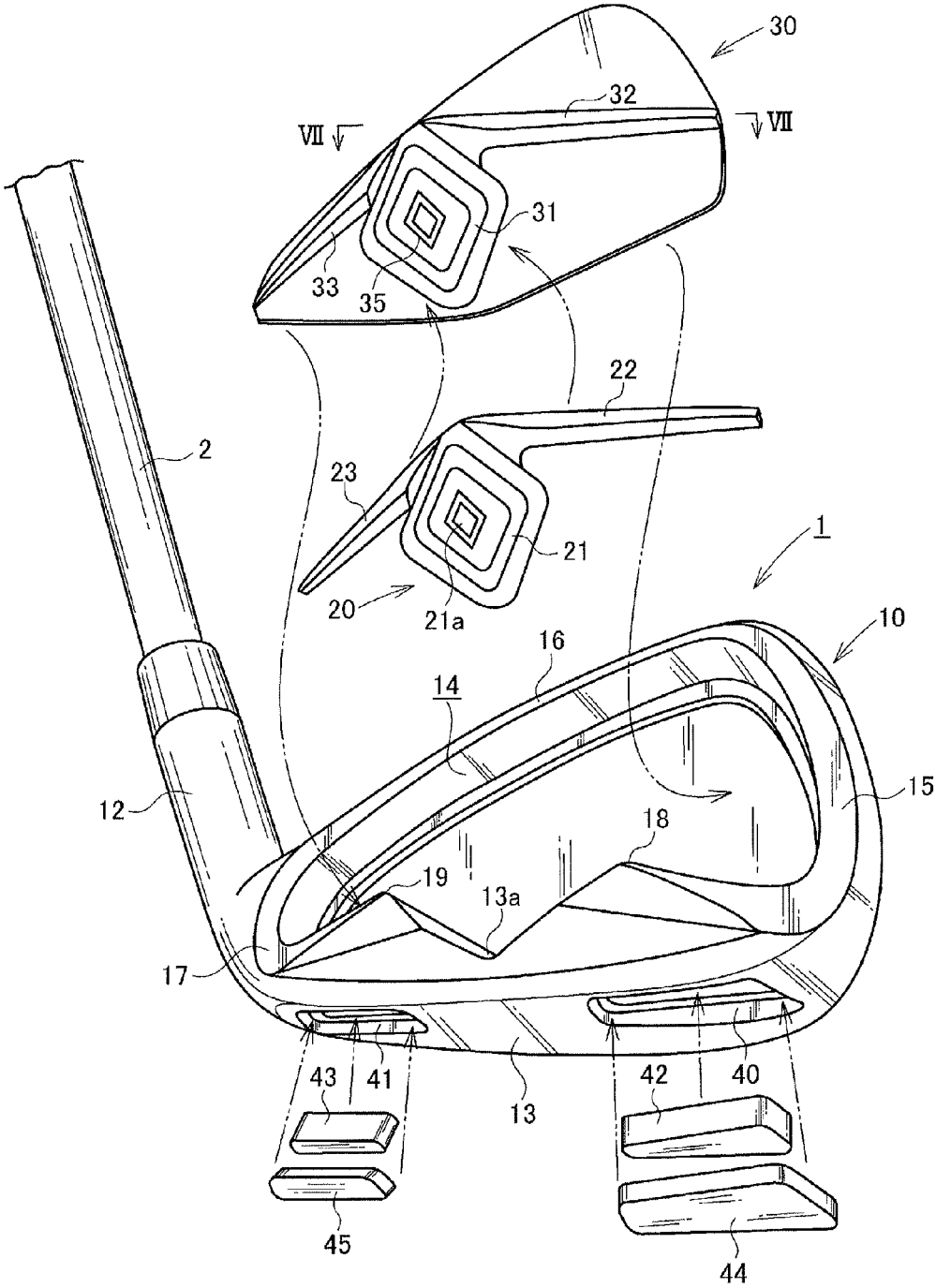
FIG. 2 is an exploded perspective view of the golf club head shown in FIG. 1.
Figure 3:
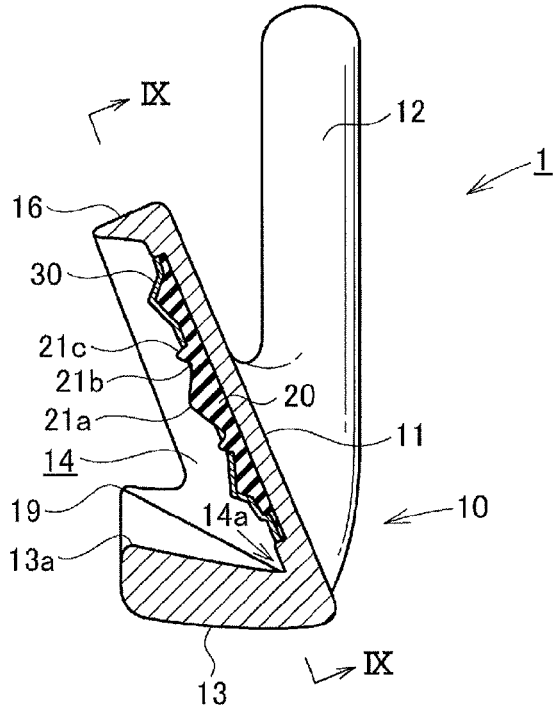
FIG. 3 is a sectional view taken along the line III-III of FIG. 1.
Figure 4:
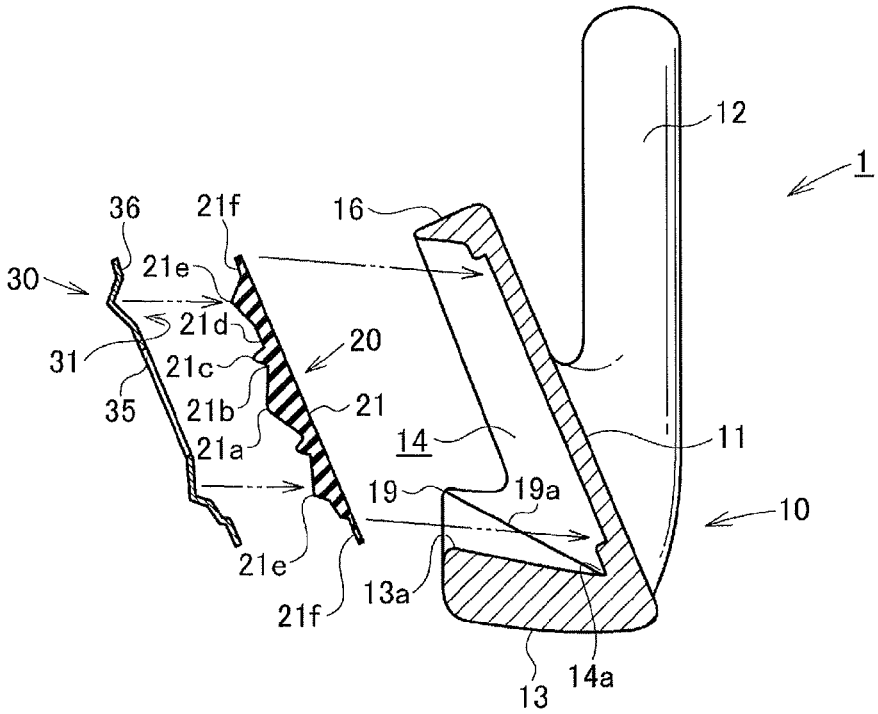
FIG. 4 is an exploded view of FIG. 3.
Figure 5:
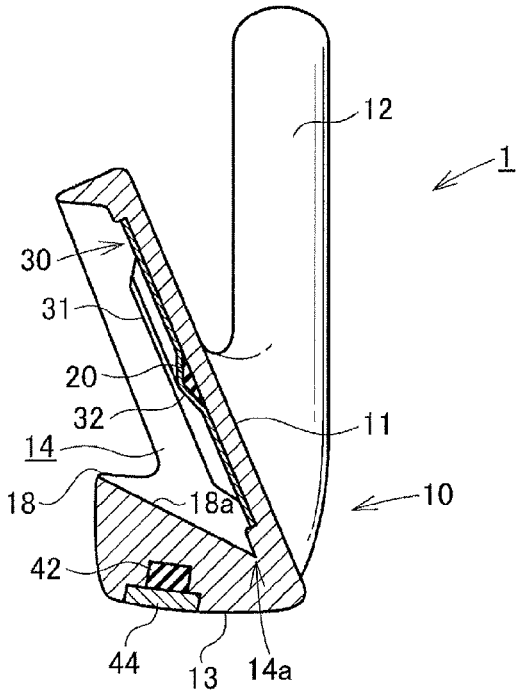
FIG. 5 is a sectional view taken along the line V-V of FIG. 1.
Figure 6:
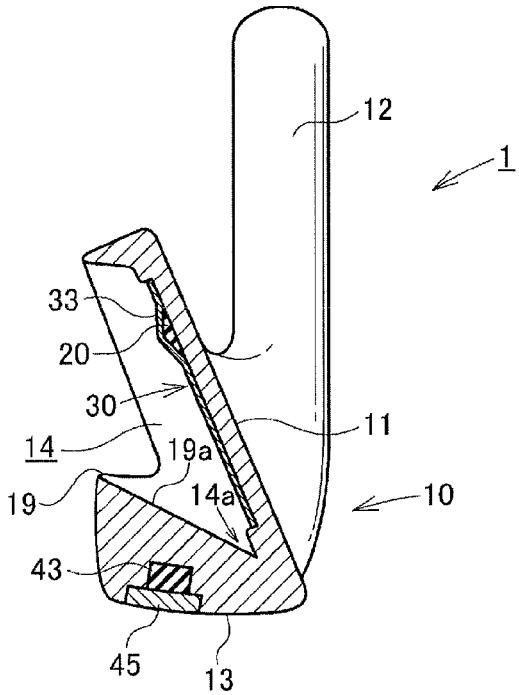
FIG. 6 is a sectional view taken along the line VI-VI of FIG. 1.

As shown in FIGS. 2 to 4, the viscoelastic body 20 has a substantially rhombic board-shaped part 21, a toe-side extending part 22 extending from the board-shaped part 21 to the toe side, and a heel-side extending part 23 extending from the board-shaped part 21 to the heel side. In the center of the board-shaped part 21, a first convex part 21*a* exists, and a first concave part 21*b* is provided so as to surround the first convex part 21*a*, a second convex part 21*c* is provided so as to surround the first concave part 21*b*, a second concave part 21*d* is provided so as to surround the second convex part 21*c*, a third convex part 21*e* is provided so as to surround the second concave part 21*d*, and a thin-plate part 21*f* at the outermost periphery is provided so as to surround the third convex part 21*e*.

The toe-side extending part 22 and the heel-side extending part 23 are connected to the upper portions of the board-shaped part 21, and extend to the toe side and the heel side, respectively. The toe-side extending part 22 has a length reaching the toe side of the cover plate 30. The heel-side extending part 23 has a length reaching the heel side of the cover plate 30.

As a material for the viscoelastic body 20, rubber or elastomer having viscoelasticity is suitable. As a suitable material of rubber or elastomer, the materials that are the same as the materials for the vibration absorbing materials 42 and 43 are cited, and among these materials, NBR is most suitable.

The average thickness of the board-shaped part 21 of the viscoelastic body 20 is preferably 0.5 to 2.5 mm, especially about 0.8 to 1.5 mm. The vertical length of the board-shaped part 21 is preferably 10 to 30 mm, especially about 18 to 28 mm, and the maximum horizontal width thereof is preferably 15 to 35 mm, especially about 20 to 30 mm.

The width (width in the direction perpendicular to the lengthwise direction) of each of the toe-side extending part 22 and the heel-side extending part 23 is preferably about 3 to 8 mm, and the average thickness thereof is preferably 0.2 to 2.0 mm, especially 0.5 to 1.5 mm.

The cover plate 30 has a size spreading throughout the whole of the back face of the face plate part 11, that is, from the toe side to the heel side and from the top side to the sole side. In an intermediate potion in the toe-to-heel direction of the cover plate 30, a concavity 31 having a shape and size corresponding to the shape and size of the viscoelastic body 20 is provided.

In the center of the concavity 31, as shown in FIG. 4, an opening 35, into which the first convex part 21*a*, the first concave part 21*b*, and the second convex part 21*c* fit, is formed. Also, a concave line 36 with which the third convex part 21*e* engages is provided so as to surround the opening 35.

Figure 7:
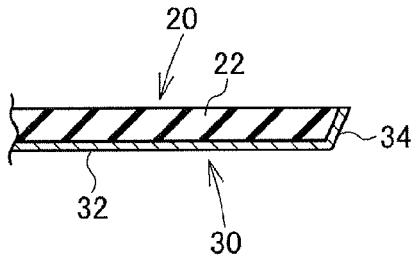
FIG. 7 is a sectional view taken along the line VII-VII of FIG. 2, showing a cover plate and a viscoelastic body.
Figure 8:
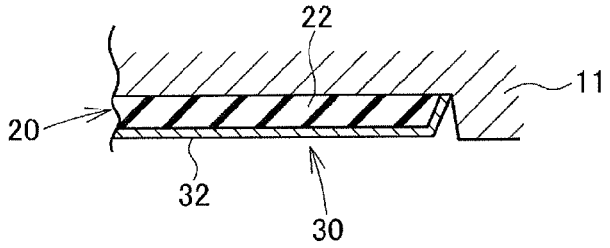
FIG. 8 is a sectional view of the back face of a face plate part.

In the cover plate 30, a toe-side concave line 32 and a heel-side concave line 33 are provided so as to extend from the upper portions of the concavity 31 toward the toe side and the heel side, respectively. With the concave lines 32 and 33, the toe-side extending part 22 and the heel-side extending part 23 of the viscoelastic body 20 engage, respectively. The concave lines 32 and 33 reach the peripheral edge portions of the cover plate 30, and, as shown in FIGS. 7 and 8, a wall part 34 for closing the concave lines 32 and 33 is provided in the peripheral edge portion of the cover plate 30.

The toe-side concave line 32 is located near the intermediate portion in the up-and-down direction of the side edge portion on the toe side of the cover plate 30, and the heel-side concave line 33 is located near the intermediate portion in the up-and-down direction of the side edge portion on the heel side of the cover plate 30.

The cover plate 30 is flat excluding the concavity 31 and the concave lines 32 and 33. In this flat portion, although not shown, an uneven pattern is provided so as to represent various letters, figures, and symbols.

In the state in which the viscoelastic body 20 engages with the concavity 31 and the concave lines 32 and 33, the faces on the face plate part 11 side of the viscoelastic body 20 and the cover plate 30 are flush.

The cover plate 30 is preferably made of a metallic material having a thickness of 0.2 to 0.4 mm, especially about 0.3 mm.

The cover plate 30 is preferably manufactured by the electroforming method, which is a molding method to which the plating technology is applied, or the press molding method.

As a metal used when the cover plate 30 is manufactured by the electroforming method, copper, nickel, chromium, zinc, gold, silver, rhodium, nickel-phosphorus alloy, or the like is suitable, and nickel is especially suitable. When the cover plate 30 is manufactured by the electroforming method, it is preferable that the surface of a base material consisting of the above-described metal be plated with a metal harder than the metal used as the base material. For example, the surface of the base material consisting of nickel is preferably plated with chromium. This plating treatment makes the cover plate 30 less liable to be damaged. Also, the coloration of the base material may be changed by partial plating.

As a metal used when the cover plate 30 is manufactured by the press molding method, aluminum, aluminum alloy, titanium, or titanium alloy, each of which has good ductility, or stainless steel, which is less liable to rust, is suitable. Aluminum, aluminum alloy, titanium, and titanium alloy are preferably subjected to anodizing treatment.

The board-shaped part 21 and the extending parts 22 and 23 of the viscoelastic body 20 are engaged with the concavity 31 and concave lines 32 and 33 of the cover plate 30, respectively, and this engaged member is affixed to the back face of the face plate part 11 with an adhesive or a gluing agent such as a double-faced adhesive tape.

The shaft is inserted in the hosel part 12 of the golf club head 1, and is fixed to the hosel part 12 with an adhesive, whereby a golf club (iron) is formed. The vibrations occurring when a ball is hit by using this iron are absorbed by the viscoelastic bodies 20, 42 and 43. Among these viscoelastic bodies, the viscoelastic body 20 has a large vibration absorption amount because it is positioned on the back face of the face plate part 11. In the present invention, the opening 35 is formed in the cover plate 30 covering this viscoelastic body 20, and a part (the convex parts 21*a* and 21*c* and the concave part 21*b* of the board-shaped part 21) is exposed through the opening 35. Therefore, the convex parts 21*a* and 21*c* and the concave part 21*b* vibrate without being restrained by the cover plate 30, so that the vibration absorbing effect is excellent. Also, since the thickness of the board-shaped part 21 is different at the portions of the convex parts 21*a* and 21*c* and the concave part 21*b*, vibrations in a wide frequency range are absorbed efficiently.

That is, in the board-shaped part 21 of the viscoelastic body 20 used in this embodiment, the portions of the convex parts 21*a*, 21*c* and 21*e* are thick, and the portions of the concave parts 21*b* and 21*d* and the thin-plate part 21*f* are thin, so that vibrations in a wide frequency range can be absorbed effectively.

In this embodiment, the bottom portion of the back face of the face plate part 11 thrusts deep to the sole side throughout the whole zone ranging from the toe side to the heel side, and the lower edge of the cover plate 30 exists down to the vicinity of the sole part 13, so that the area of the cover plate 30 is large. Therefore, the vibrations at the time when a ball is hit by a lower portion on the toe side or the heel side of the face surface propagate easily to the viscoelastic body 20 via the cover plate 30, so that the vibration absorbing effect is excellent.

In this embodiment, the tip end faces of the extending parts 22 and 23 of the viscoelastic body 20 are covered with the wall part 34 of the cover plate 30. Therefore, all of the end faces of the viscoelastic body 20 are covered with the cover plate 30 in an enclosed form, and are not exposed to the atmospheric air. For this reason, the adhesion surface of the viscoelastic body 20 and the back face of the face plate part 11 is not splashed with water, nor is it irradiated directly by ultraviolet rays, so that the durability of the viscoelastic body 20 and the durability of adhesion of the viscoelastic body 20 to the back face of the face plate part 11 are excellent. Since the areas of the tip end faces of the extending parts 22 and 23 are small, the durability of adhesion is scarcely affected even if the wall part 34 is omitted.

In this embodiment, the convex parts 21*a* and 21*c* and the concave part 21*b* of the board-shaped part 21 of the viscoelastic body 20 are exposed to the atmospheric air. However, even if these portions are splashed with water, this water does not go around to the adhesion surface of the viscoelastic body 20 and the face plate part 11.

In this embodiment, the convex part 21*e* of the board-shaped part 21 of the viscoelastic body 20 fits snugly into the concavity 31 provided in the cover plate 30, and the viscoelastic body 20 is held firmly on the back face of the face plate part 11. Also, since the cover plate 30 is flat excluding the concavity 31 and the concave lines 32 and 33, the cover plate 30 can be adherently held to the face plate part 11 firmly.

In this embodiment, since the viscoelastic body 20 is provided with the extending parts 22 and 23 on the toe side and the heel side, respectively, the vibrations at the time when a ball is hit by the toe side or the heel side of the face plate part 11 are immediately absorbed by the extending part 22 or 23 located just close to the hit portion, so that the vibration absorbing effect is high. The vibrations at the time when a ball is hit by a portion that does not lap over the board-shaped part 21 and the extending parts 22 and 23 of the face surface (for example, an upper portion or a lower portion on the toe side or an upper portion or a lower portion on the heel side of the face surface) propagate to the viscoelastic body 20 via not only the face plate part 11 but also the flat portion (the portion excluding the concavity 31 and the concave lines 32 and 33) of the cover plate 30 and are absorbed by the viscoelastic body 20.

In the present invention, the bottom portion of the back face of the face plate part 11 thrusts deep to the sole side throughout the whole zone ranging from the toe side to the heel side, and the lower edge of the cover plate 30 exists down to the vicinity of the sole part 13, so that the area of the cover plate 30 is large. Therefore, the vibrations at the time when a ball is hit by a lower portion on the toe side or the heel side of the face surface propagate easily to the viscoelastic body 20 via the cover plate 30, so that the vibration absorbing effect is excellent.

In the board-shaped part 21 of the viscoelastic body 20 used in this embodiment, the portions of the convex parts 21*a*, 21*c* and 21*e* are thick, and the portions of the concave parts 21*b* and 21*d* and the thin-plate part 21*f* are thin, so that vibrations having various frequencies can be absorbed effectively.

The adhesive or the gluing agent used for the adhesion of the viscoelastic body 20 and the cover plate 30 also achieves an effect of absorbing vibrations in the direction along the back face of the face plate part 11 (in-plane direction). The provision of the concavity 31, the toe-side concave line 32, and the heel-side concave line 33 in the cover plate 30 can enhance the rigidity of the cover plate 30 even if the cover plate 30 is thin. In particular, the provision of the toe-side concave line 32 and the heel-side concave line 33 can enhance the rigidity in the toe-to-heel direction of the cover plate 30.

The above-described embodiment is one example of the present invention, and the present invention may adopt a mode other than illustrated. For example, the shapes of the viscoelastic body 20 and the cover plate 30 and the size and shape of the opening may be other than illustrated. Also, the configuration may be such that the opening 35 in the cover plate 30 is omitted, and the whole of the back face of the viscoelastic body 20 is covered with the cover plate 30.

Hereunder, a second embodiment of the golf club head in accordance with the present invention is described with reference to FIGS. 10 to 16. A wood-type golf club head 50 in the second embodiment is a driver wood; however, this golf club head 50 may be a wood of No. 2 or higher grade. Also, the present invention can be applied to a utility-type golf club head having a shape approximate to that of the wood-type golf club head.

The wood-type golf club head 50 is a hollow golf club head formed by using a raw material such as titanium alloy, stainless steel, or CFRP, and includes a face surface 51 for hitting a ball, a hosel part 53 for attaching a shaft 52, a sole face 54, and a crown part 55. In a rear portion of the sole face 54, a depressed part 56 is provided.

In this embodiment, the depressed part 56 is disposed in an intermediate portion in the toe-to-heel direction, and extends in the toe-to-heel direction. On the heel side and the toe side of the depressed part 56, convex line parts 57 and 59 extending toward the face surface side are provided, respectively. Also, a convex line part 59 is provided along the rear edge of the depressed part 56.

The depressed part 56 is composed of a rising surface rising from the sole face and a substantially flat bottom surface.

In the depressed part 56, a viscoelastic body 60 is made to adhere to the bottom surface of the depressed part 56, and a cover plate 70 is provided so as to cover the viscoelastic body 60. The viscoelastic body 60 has a flat plate shape and a size slightly smaller than the size of the bottom surface of the depressed part 56.

Figure 14:
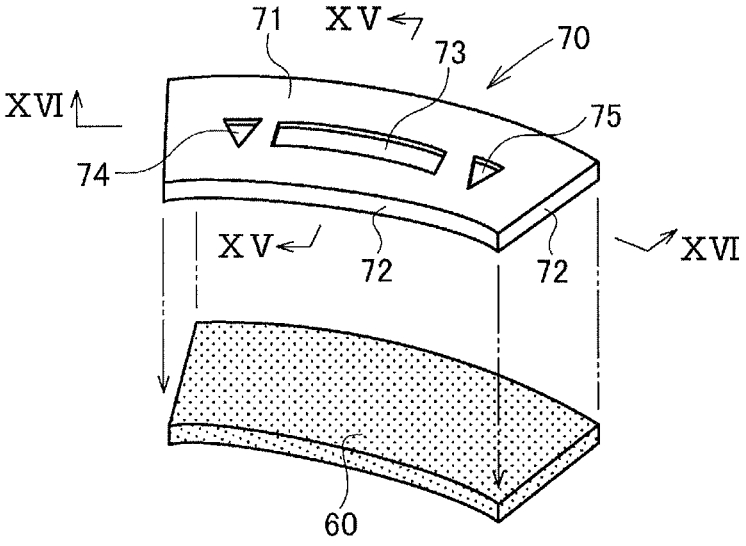
FIG. 14 is a perspective view of a viscoelastic body and a cover plate.
Figure 15:
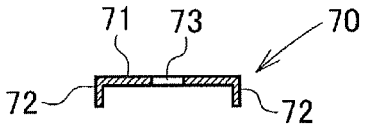
FIG. 15 is a sectional view taken along the line XV-XV of FIG. 14.
Figure 16:
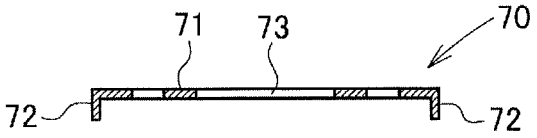
FIG. 16 is a sectional view taken along the line XVI-XVI of FIG. 14.

As shown in FIGS. 14 and 15, the cover plate 70 has a main surface part 71 lapping over the viscoelastic body 60, a frame wall part 72 rising from the peripheral edge of the main surface part 71, a slender and substantially rectangular first opening 73 formed in the main surface part 71, and a second opening 74 and a third opening 75 that are adjacent to the first opening 73. The first opening 73 extends in the toe-to-heel direction. The second opening 74 is located on the toe side of the first opening 73, and the third opening 75 is located on the heel side of the first opening 73. In this embodiment, the second opening 74 and the third opening 75 are of a triangular shape; however, they may be of a circular shape, an elliptical shape, a square shape, a polygonal shape, a star shape, or the like shape. Also, a fourth opening or more openings may be formed.

The viscoelastic body 60 is made to adhere to the bottom surface of the depressed part 56 with an adhesive or a gluing agent. The cover plate 70 is made to adhere to the viscoelastic body 60 with an adhesive or a gluing agent.

The shaft 52 is inserted in the hosel part 53 of the golf club head 50, and is fixed to the hosel part 53 with an adhesive, whereby a golf club (wood) is formed.

The vibrations at the time when a ball is hit by using this head 50 are absorbed by the viscoelastic body 60. Since the convex line parts 57 and 58 are provided on the sole face, the vibrations transmitted from the face surface 51 easily propagate to the depressed part 56 side, and is easily absorbed by the viscoelastic body 60.

The openings 73 to 75 are formed in the cover plate 70 for covering viscoelastic body 60, and a part of the viscoelastic body 60 is exposed through these openings 73 to 75. Therefore, the viscoelastic body 60 is not restrained by the cover plate 70 in the portions of the openings 73 to 75, so that the vibration absorbing effect is excellent.

The adhesive or the gluing agent used for the adhesion of the viscoelastic body 60 and the cover plate 70 also achieves an effect of absorbing vibrations in the sole face direction.

For the golf club head 50, the viscoelastic body 60 is made to adhere to the bottom surface of the depressed part 56, and further the cover plate 70 is provided so as to cover the viscoelastic body 60. The end face of the viscoelastic body 60 is covered with the frame wall part 72 of the cover plate 70. Therefore, all of the end faces of the viscoelastic body 60 are covered with the cover plate 70 in an enclosed form so as not be exposed to the atmospheric air. For this reason, the adhesion surface of the viscoelastic body 60 and the bottom surface of the depressed part 56 is not splashed with water, nor is it irradiated directly by ultraviolet rays, so that the durability of the viscoelastic body 60 and the durability of adhesion of the viscoelastic body 60 are excellent.

In this embodiment, a part of the viscoelastic body 60 is exposed to the atmospheric air via the openings 73, 74 and 75. However, even if these portions are splashed with water, this water does not go around to the adhesion surface of the viscoelastic body 60 and the bottom surface of the depressed part 56.

The above-described embodiment is one example of the present invention, and the present invention may adopt a mode other than shown. For example, the shapes of the viscoelastic body 60 and the cover plate 70 and the sizes and shapes of the openings may be other than shown.

What is claimed is:

1. A golf club head, which is of an iron type, comprising:

a face plate part for hitting a ball, which has a cavity part on the back side thereof;

a sole part;

a hosel part for connecting the head to a shaft;

a viscoelastic body made to adhere to the back face of the face plate part, the viscoelastic body comprising a board-shaped part located on the back face of a central portion of the face plate part and extending parts extending from the board-shaped part to the toe side and the heel side of the head; and a cover plate lapping over the viscoelastic body, the cover plate comprising a concavity for accommodating the board-shaped part of the viscoelastic body and concave lines for accommodating the extending parts of the viscoelastic body.

2. The golf club head according to claim 1, wherein the tip end faces of the extending parts of the viscoelastic body are covered with a wall part formed in the peripheral edge portion of the cover plate.

3. The golf club head according to claim 1, wherein the viscoelastic body and the cover plate are affixed to the back face of the face plate part with an adhesive or a gluing agent.

4. The golf club head according to claim 1, wherein the cover plate is formed of a metal having a thickness of 0.2 to 0.4 mm.

5. The golf club head according to claim 1, wherein the sole part comprises mountain parts, which are convex from the face of the sole part on the cavity part side toward the substantially vertical direction on the toe side and the heel side thereof, and valley parts, which are located between the mountain parts; and the surface connecting the top portions of the mountain parts with the back face of the face plate part is inclined toward the sole part with respect to the outer side surface of the sole part.

6. The golf club head according to claim 5, wherein the distance between the lowermost edge of the back face of the face plate part and the outer side surface of the sole part increases gradually from the center part toward the toe side and the heel side.

* * * * *